US010272706B2

(12) United States Patent
Arakane

(10) Patent No.: US 10,272,706 B2
(45) **Date of Patent: *Apr. 30, 2019**

(54) INKJET PRINTER AND METHOD FOR ACQUIRING GAP INFORMATION

(71) Applicant: BROTHER KOGYO KABUSHIKI KAISHA, Nagoya, Aichi (JP)

(72) Inventor: Satoru Arakane, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/876,722

(22) Filed: Jan. 22, 2018

(65) Prior Publication Data

US 2018/0194149 A1 Jul. 12, 2018

Related U.S. Application Data

(63) Continuation of application No. 15/369,323, filed on Dec. 5, 2016, now Pat. No. 9,873,272, which is a (Continued)

(30) Foreign Application Priority Data

Mar. 30, 2012 (JP) ..... 2012-082619

(51) Int. Cl.
*B41J 25/308* (2006.01)
*B41J 2/21* (2006.01)
(Continued)

(52) U.S. Cl.
CPC ..... *B41J 25/308* (2013.01); *B41J 2/01* (2013.01); *B41J 2/04556* (2013.01);
(Continued)

(58) Field of Classification Search
CPC ..... B41J 2/01; B41J 2/04556; B41J 2/2135; B41J 11/005; B41J 11/0095; B41J 19/145; B41J 25/006; B41J 29/393
See application file for complete search history.

(56) References Cited

U.S. PATENT DOCUMENTS 5,366,301 A 11/1994 Martin et al.
5,515,094 A 5/1996 Tanaka et al.
(Continued)

FOREIGN PATENT DOCUMENTS

CN 1990242 A 7/2007
CN 101058244 A 10/2007
(Continued)

OTHER PUBLICATIONS

Notice of Allowance dated May 25, 2018 received in related U.S. Appl. No. 15/830,424.
(Continued)

*Primary Examiner* — Lamson Nguyen
(74) *Attorney, Agent, or Firm* — Scully, Scott, Murphy & Presser, P.C.

(57) ABSTRACT

An inkjet printer is provided, which is configured to acquire gap information related to a gap between an ink discharging surface and a recording sheet in each individual position of top-formed positions and bottom-formed positions within a predetermined wave-shape generating range, identify, when the predetermined wave-shape generating range includes a partial range in which the recording sheet is not placed, a top-formed position where the gap information has not been acquired and a bottom-formed position where the gap information has not been acquired, within the partial range, complement the unacquired gap information in the identified top-formed position with a value determined based on the respective pieces of gap information acquired in other top-formed positions, and complement the unacquired gap
(Continued)

information in the identified bottom-formed position with a value determined based on the respective pieces of gap information acquired in other bottom-formed positions.

7 Claims, 10 Drawing Sheets

Related U.S. Application Data continuation of application No. 14/879,927, filed on Oct. 9, 2015, now Pat. No. 9,511,606, which is a continuation of application No. 14/542,025, filed on Nov. 14, 2014, now Pat. No. 9,156,295, which is a continuation of application No. 14/223,334, filed on Mar. 24, 2014, now Pat. No. 8,888,227, which is a continuation of application No. 13/729,697, filed on Dec. 28, 2012, now Pat. No. 8,714,693.

(51) Int. Cl.

| | |
|---|---|
| ***B41J 11/00*** | (2006.01) |
| ***B41J 19/14*** | (2006.01) |
| ***B41J 29/393*** | (2006.01) |
| ***B41J 2/045*** | (2006.01) |
| ***B41J 2/01*** | (2006.01) |
| ***B41J 25/00*** | (2006.01) |

(52) U.S. Cl.

CPC ..... *B41J 2/2135* (2013.01); *B41J 11/005* (2013.01); *B41J 11/0095* (2013.01); *B41J 19/145* (2013.01); *B41J 25/006* (2013.01); *B41J 29/393* (2013.01)

(56) References Cited

U.S. PATENT DOCUMENTS

| | | | |
|---|---|---|---|
| 5,659,404 | A | 8/1997 | Matsuda |
| 5,847,719 | A | 12/1998 | Yamaguchi et al. |
| 6,092,939 | A | 7/2000 | Nishikori et al. |
| 6,310,637 | B1 | 10/2001 | Shimada et al. |
| 6,336,703 | B1 | 1/2002 | Otsuki |
| 6,604,803 | B1 | 8/2003 | Hanabusa et al. |
| 6,827,418 | B2 | 12/2004 | Otokita |
| 6,900,449 | B2 | 5/2005 | Bolash et al. |
| 6,964,476 | B2 | 11/2005 | Okamoto |
| 7,083,245 | B2 | 8/2006 | Yamamoto |
| 7,267,419 | B2 | 9/2007 | Yamasaki |
| 7,309,179 | B2 | 12/2007 | Toran et al. |
| 7,530,659 | B2 | 5/2009 | Doherty et al. |
| 8,118,382 | B2 | 2/2012 | Hampel et al. |
| 8,118,422 | B2 | 2/2012 | Hibbard et al. |
| 8,282,194 | B2 | 10/2012 | Ozawa |
| 8,556,382 | B2 | 10/2013 | Kang |
| 8,714,693 | B2 | 5/2014 | Arakane |
| 8,740,328 | B2 | 6/2014 | Terada |
| 8,882,215 | B2 | 11/2014 | Arakane |
| 8,888,227 | B2 | 11/2014 | Arakane |
| 9,156,295 | B2 * | 10/2015 | Arakane ..... B41J 2/04556 |
| 9,162,441 | B1 | 10/2015 | Noda |
| 9,162,502 | B2 | 10/2015 | Terada |
| 9,315,056 | B2 | 4/2016 | Arakane |
| 9,481,189 | B2 | 11/2016 | Arakane |
| 9,873,272 | B2 | 1/2018 | Arakane |
| 2002/0196298 | A1 | 12/2002 | Cheng et al. |
| 2003/0001939 | A1 | 1/2003 | Scofield et al. |
| 2004/0126164 | A1 | 7/2004 | Ohyama |
| 2004/0223017 | A1 | 11/2004 | Otsuki |
| 2005/0052487 | A1 | 3/2005 | Yamasaki |
| 2005/0168557 | A1 | 8/2005 | Ohyama |
| 2007/0040878 | A1 | 2/2007 | Ikefuji et al. |
| 2007/0229562 | A1 | 10/2007 | Doherty et al. |
| 2007/0291077 | A1 | 12/2007 | Seki et al. |
| 2008/0150978 | A1 | 6/2008 | Sato et al. |
| 2009/0085949 | A1 | 4/2009 | Sugiyama et al. |
| 2009/0122098 | A1 | 5/2009 | Shindo |
| 2009/0251521 | A1 | 10/2009 | Arai |
| 2009/0262157 | A1 | 10/2009 | Sato et al. |
| 2011/0175958 | A1 | 7/2011 | Sato et al. |
| 2011/0249049 | A1 | 10/2011 | Taira et al. |
| 2012/0063800 | A1 | 3/2012 | Rossell et al. |

FOREIGN PATENT DOCUMENTS

| | | | |
|---|---|---|---|
| EP | 0622227 | A2 | 11/1994 |
| EP | 0622227 | A3 | 8/1995 |
| EP | 1160088 | A2 | 12/2001 |
| EP | 1160088 | A3 | 12/2001 |
| EP | 1182041 | A1 | 2/2002 |
| EP | 1449663 | A1 | 8/2004 |
| JP | 11-138923 | A | 5/1995 |
| JP | H08-307688 | A | 11/1996 |
| JP | H10-138463 | A | 5/1998 |
| JP | H11-151242 | A | 6/1999 |
| JP | 2000-71532 | A | 3/2000 |
| JP | 2001-096733 | A | 4/2001 |
| JP | 2002-160357 | A | 6/2002 |
| JP | 2003-54078 | A | 2/2003 |
| JP | 2004-17586 | A | 1/2004 |
| JP | 2004-106978 | A | 4/2004 |
| JP | 2007-144666 | A | 8/2004 |
| JP | 3554184 | B2 | 8/2004 |
| JP | 2004-314361 | A | 11/2004 |
| JP | 2006-192636 | A | 7/2006 |
| JP | 2006-192814 | A | 7/2006 |
| JP | 2007-25492 | A | 2/2007 |
| JP | 2007-144666 | A | 6/2007 |
| JP | 2007-144718 | A | 6/2007 |
| JP | 2008-155423 | A | 7/2008 |
| JP | 2008-155424 | A | 7/2008 |
| JP | 2008-230069 | A | 10/2008 |
| JP | 2009-23121 | A | 2/2009 |
| JP | 2009-143152 | A | 7/2009 |
| JP | 2009-178986 | A | 8/2009 |
| JP | 2009-202430 | A | 9/2009 |
| JP | 2009-255386 | A | 11/2009 |
| JP | 2011-218625 | A | 11/2011 |

OTHER PUBLICATIONS

United States Official Action dated Mar. 30, 2018 received in related U.S. Appl. No. 15/243,358.

Extended European Search Report dated Jul. 11, 2013 from related EP 12199734.0 from parent U.S. Appl. No. 13/729,697.

Notice of Allowance dated Dec. 24, 2013 from related U.S. Appl. No. 13/729,697.

Notice of Allowance dated Jul. 18, 2014 from related U.S. Appl. No. 14/223,334.

U.S. Official Action dated Dec. 18, 2014 received in related U.S. Appl. No. 14/542,025.

Notice of Allowance dated Jun. 8, 2015 from related U.S. Appl. No. 14/542,025.

Japanese Notification of Reasons for Rejection dated Jul. 26, 2016 received in related application JP 2015-173555 together with an English language translation.

Japanese Official Action dated Feb. 2, 2016 received in related application JP 2012-286356 together with an English language translation.

Japanese Official Action dated Feb. 2, 2016 received in related application JP 2012-286357 together with an English language translation.

Japanese Official Action dated Feb. 2, 2016 received in related application JP 2012-286358 together with an English language translation.

U.S. Official Action dated Mar. 24, 2016 received in related U.S. Appl. No. 14/879,927.

Notice of Allowance dated Aug. 3, 2016 from related U.S. Appl. No. 14/879,927.

United States Notice of Allowance dated Apr. 12, 2017 received in related U.S. Appl. No. 15/278,737.

(56) References Cited

OTHER PUBLICATIONS

United States Notice of Allowance dated May 4, 2017 received in related U.S. Appl. No. 15/131,667.
Extended European Search Report dated Jul. 9, 2013 from related EP 12199743.1.
European Official Action dated Dec. 21, 2015 received in related application EP 12 199 743.1.
Notification of Reasons for Rejection dated Jan. 27, 2017 received in related application JP 2015-173555 together with an English language translation.
Extended European Search Report dated Jul. 10, 2013 from related EP 12199749.8.
Notice of Allowance dated Jul. 9, 2014 issued in U.S. Appl. No. 13/728,629, filed Dec. 27, 2012.
Office Action dated Jan. 9, 2015 issued in U.S. Appl. No. 14/535,845, filed Nov. 7, 2014.
Office Action dated Jul. 9, 2015 issued in U.S. Appl. No. 14/535,845, filed Nov. 7, 2014.
Office Action dated Oct. 5, 2016 issued in U.S. Appl. No. 15/131,667, filed Apr. 18, 2016.
Extended European Search Report dated Jul. 9, 2013 from related EP 12199740.7 from parent U.S. Appl. No. 13/729,753.
Notice of Allowance dated Jan. 8, 2014 from related U.S. Appl. No. 13/729,753.
Notification of First Office Action dated Sep. 4, 2014 received from the Chinese Patent Office from related Chinese Patent Application No. 201210586540.3, together with an English language translation.
Notice of Allowance dated Sep. 2, 2014 from related U.S. Appl. No. 14/246,238.
Notice of Reasons for Rejection dated Jul. 15, 2014 from related Japanese Application No. 2012-082621, together with an English language translation.
Japanese Official Action dated Feb. 17, 2015 received in related application JP 2012-082621 together with an English language translation.
Notice of Allowance dated Feb. 20, 2015 from related U.S. Appl. No. 14/587,267.
Notice of Allowance dated Jun. 12, 2015 from related U.S. Appl. No. 14/587,267.
Notice of Allowance dated Jul. 23, 2015 from related U.S. Appl. No. 14/587,267.
Official Action dated Jan. 4, 2016 from related U.S. Appl. No. 14/886,527.
Notice of Allowance dated May 27, 2016 from related U.S. Appl. No. 14/886,527.
Extended European Search Report dated Jul. 9, 2013 from related EP 12199737.3.
U.S. Office Action dated Feb. 5, 2014 from related U.S. Appl. No. 13/729,386.
U.S. Office Action dated May 13, 2014 from related U.S. Appl. No. 13/729,386.
U.S. Office Action dated Apr. 15, 2015 from related U.S. Appl. No. 13/729,386.
U.S. Office Action dated Nov. 2, 2015 from related U.S. Appl. No. 13/729,386.
Notice of Allowance dated Apr. 18, 2016 from related U.S. Appl. No. 13/729,386.
Notification of Reasons for Rejection dated Sep. 20, 2016 issued in Japanese Application No. 2012-286358.
U.S. Office Action dated Feb. 14, 2017 from related U.S. Appl. No. 15/243,358.
U.S. Office Action dated May 5, 2017 from related U.S. Appl. No. 15/369,323.
Notice of Allowance dated Sep. 15, 2017 from related U.S. Appl. No. 15/369,323.
List of Patents or Patent Applications Treated as Related dated Jan. 22, 2018, 3 pages.
Notice of Allowance dated Sep. 4, 2018 from related U.S. Appl. No. 15/796,935.

* cited by examiner

INKJET PRINTER AND METHOD FOR ACQUIRING GAP INFORMATION

CROSS-REFERENCE TO RELATED APPLICATION

This application is a continuation application of U.S. Ser. No. 15/369,323 filed on Dec. 5, 2016, which is a continuation application of U.S. Ser. No. 14/879,927 filed on Oct. 9, 2015, now U.S. Pat. No. 9,511,606, which is a continuation application of U.S. Ser. No. 14/542,025 filed on Nov. 14, 2014, now U.S. Pat. No. 9,156,295, which is a continuation application of U.S. Ser. No. 14/223,334 filed on Mar. 24, 2014, now U.S. Pat. No. 8,888,227, which is a continuation application of U.S. Ser. No. 13/729,697 filed on Dec. 28, 2012, now U.S. Pat. No. 8,714,693 and claims priority under 35 U.S.C. § 119 from Japanese Patent Application No. 2012-082619 filed on Mar. 30, 2012. The entire subject matter of each of which are incorporated herein by reference.

BACKGROUND

Technical Field

The following description relates to one or more techniques for acquiring gap information related to a gap between an ink discharging surface of an inkjet head and a recording medium in an inkjet printer.

Related Art

As an example of inkjet printers configured to perform printing by discharging ink from nozzles onto a recording medium, an inkjet printer has been known that is configured to perform printing by discharging ink onto a recording sheet (a recording medium) from a recording head (an inkjet head) mounted on a carriage reciprocating along a predetermined scanning direction. Further, the known inkjet printer is configured to cause feed rollers or corrugated holding spur wheels to press the recording sheet against a surface of a platen that has thereon convex portions and concave portions alternately formed along the scanning direction, so as to deform the recording sheet in a predetermined wave shape. The predetermined wave shape has mountain portions protruding toward an ink discharging surface of the recording head, and valley portions recessed in a direction opposite to the direction toward the ink discharging surface, the mountain portions and the valley portions alternately arranged along the scanning direction.

SUMMARY

In the known inkjet printer, the gap between the ink discharging surface of the recording head and the recording sheet varies depending on portions (locations) on the recording sheet deformed in the wave shape (hereinafter, which may be referred to as a "wave-shaped recording sheet"). Therefore, when the known inkjet printer performs printing by discharging ink from the recording head onto the wave-shaped recording sheet with the same ink discharging timing as when performing printing on a recording sheet not deformed in such a wave shape, an ink droplet might land in a position deviated from a desired position on the recording sheet. Thus, it might result in a low-quality printed image. Further, in this case, the positional deviation value with respect to the ink landing position on the recording sheet varies depending on the portions (locations) on the recording sheet.

In view of the above problem, for instance, the following method is considered as a measure for discharging an ink droplet in a desired position on the wave-shaped recording sheet. The method is to adjust ink discharging timing (a moment) to discharge an ink droplet from the inkjet head depending on a gap between the ink discharging surface of the inkjet head and each individual portion of the mountain portions and the valley portions on the recording sheet. Further, in order to adjust the ink discharging timing, it is required to acquire gap information related to the gap between the ink discharging surface of the inkjet head and each individual portion of the mountain portions and the valley portions on the recording sheet over a whole predetermined printing range in the scanning direction.

Aspects of the present invention are advantageous to provide one or more improved techniques for an inkjet printer that make it possible to acquire gap information related to a gap between an ink discharging surface of an inkjet head and each individual portion of mountain portions and valley portions on a recording sheet deformed in a wave shape over a whole predetermined range.

According to aspects of the present invention, an inkjet printer is provided, which includes an inkjet head configured to discharge ink droplets from nozzles formed in an ink discharging surface thereof, a head scanning unit configured to reciprocate the inkjet head relative to a recording sheet along a scanning direction parallel to the ink discharging surface, a wave shape generating mechanism configured to deform, in a predetermined range within a movable range of the inkjet head in the scanning direction, the recording sheet in a predetermined wave shape that has tops of portions protruding in a first direction toward the ink discharging surface and bottoms of portions recessed in a second direction opposite to the first direction, the tops and the bottoms alternately arranged along the scanning direction, a gap information acquiring device configured to acquire gap information related to a gap between the ink discharging surface and the recording sheet in each individual position of a plurality of top-formed positions and a plurality of bottom-formed positions within the predetermined range, each top-formed position being a position where a corresponding one of the tops is formed on the recording sheet, each bottom-formed position being a position where a corresponding one of the bottoms is formed on the recording sheet, an identifying device configured to, when the predetermined range includes a partial range in which the recording sheet is not placed, identify a top-formed position where the gap information is not acquired by the gap information acquiring device and a bottom-formed position where the gap information is not acquired by the gap information acquiring device, within the partial range, and a gap information complementing device configured to complement the unacquired gap information in the top-formed position identified by the identifying device with a value determined based on the respective pieces of gap information acquired in other top-formed positions by the gap information acquiring device, and complement the unacquired gap information in the bottom-formed position identified by the identifying device with a value determined based on the respective pieces of gap information acquired in other bottom-formed positions by the gap information acquiring device.

According to aspects of the present invention, further provided is an inkjet printer that includes an inkjet head configured to discharge ink droplets from nozzles formed in an ink discharging surface thereof, a wave shape generating mechanism configured to deform, in a predetermined range in a predetermined direction, a recording sheet in a predetermined wave shape that has tops of portions protruding in a first direction toward the ink discharging surface and bottoms of portions recessed in a second direction opposite to the first direction, the tops and the bottoms alternately arranged along the predetermined direction, and a control device configured to acquire gap information related to a gap between the ink discharging surface and the recording sheet in each individual position of a plurality of top-formed positions and a plurality of bottom-formed positions within the predetermined range, each top-formed position being a position where a corresponding one of the tops is formed on the recording sheet, each bottom-formed position being a position where a corresponding one of the bottoms is formed on the recording sheet, identify, when the predetermined range includes a partial range in which the recording sheet is not placed, a top-formed position where the gap information is not acquired and a bottom-formed position where the gap information is not acquired, within the partial range, complement the unacquired gap information in the identified top-formed position with a value determined based on the respective pieces of gap information acquired in other top-formed positions, and complement the unacquired gap information in the identified bottom-formed position with a value determined based on the respective pieces of gap information acquired in other bottom-formed positions.

According to aspects of the present invention, further provided is a method configured to be implemented on a control device connected with an inkjet printer, the inkjet printer including an inkjet head configured to discharge ink droplets from nozzles formed in an ink discharging surface thereof, a head scanning unit configured to reciprocate the inkjet head relative to a recording sheet along a scanning direction parallel to the ink discharging surface, and a wave shape generating mechanism configured to deform, in a predetermined range within a movable range of the inkjet head in the scanning direction, the recording sheet in a predetermined wave shape that has tops of portions protruding in a first direction toward the ink discharging surface and bottoms of portions recessed in a second direction opposite to the first direction, the tops and the bottoms alternately arranged along the scanning direction, the method including steps of acquiring gap information related to a gap between the ink discharging surface and the recording sheet in each individual position of a plurality of top-formed positions and a plurality of bottom-formed positions within the predetermined range, each top-formed position being a position where a corresponding one of the tops is formed on the recording sheet, each bottom-formed position being a position where a corresponding one of the bottoms is formed on the recording sheet, identifying, when the predetermined range includes a partial range in which the recording sheet is not placed, a top-formed position where the gap information is not acquired in the acquiring step and a bottom-formed position where the gap information is not acquired in the acquiring step, within the partial range, complementing the unacquired gap information in the top-formed position identified in the identifying step with a value determined based on the respective pieces of gap information acquired in other top-formed positions in the acquiring step, and complementing the unacquired gap information in the bottom-formed position identified in the identifying step with a value determined based on the respective pieces of gap information acquired in other bottom-formed positions in the acquiring step.

BRIEF DESCRIPTION OF THE ACCOMPANYING DRAWINGS

Figure 1:
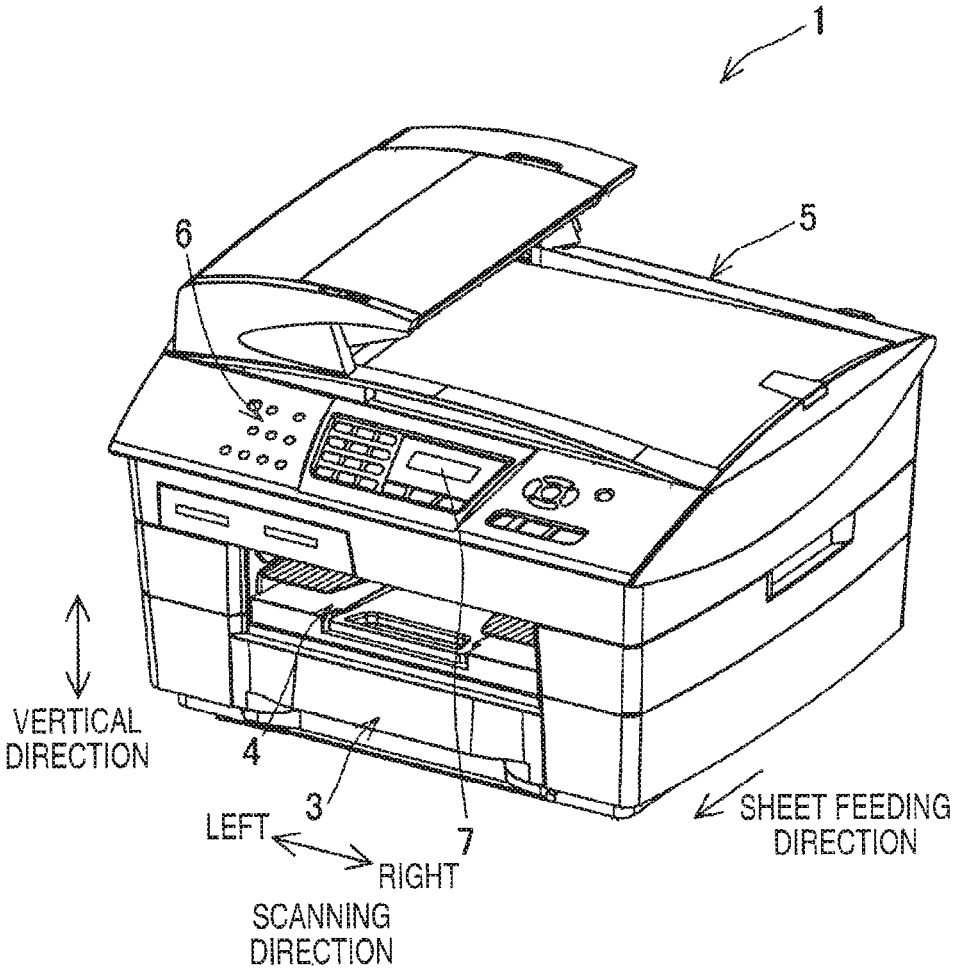
FIG. 1 is a perspective view schematically showing a configuration of an inkjet printer in an embodiment according to one or more aspects of the present invention.
Figure 2:
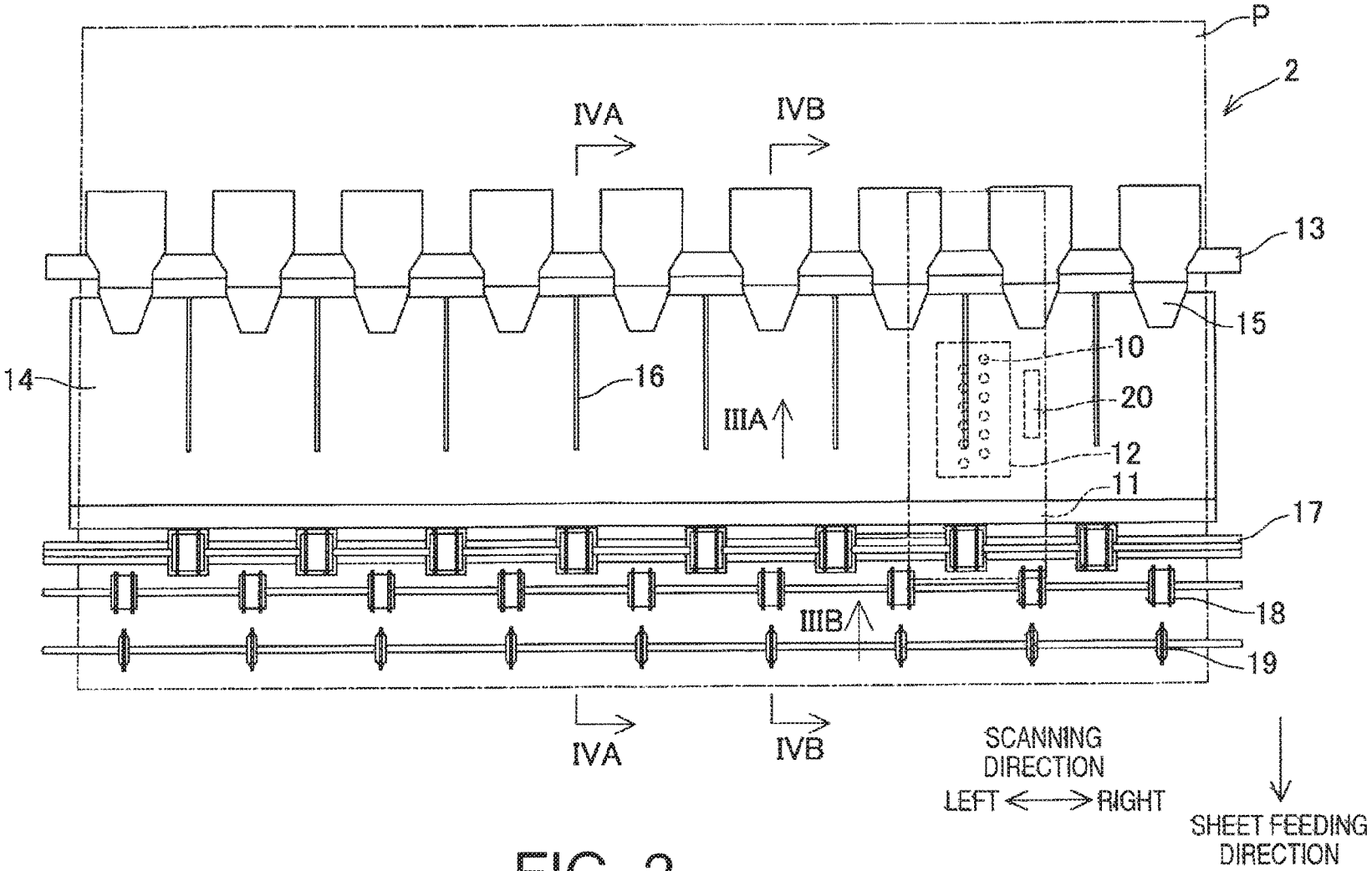
FIG. 2 is a top view of a printing unit of the inkjet printer in the embodiment according to one or more aspects of the present invention.
Figures 3A, 3B:
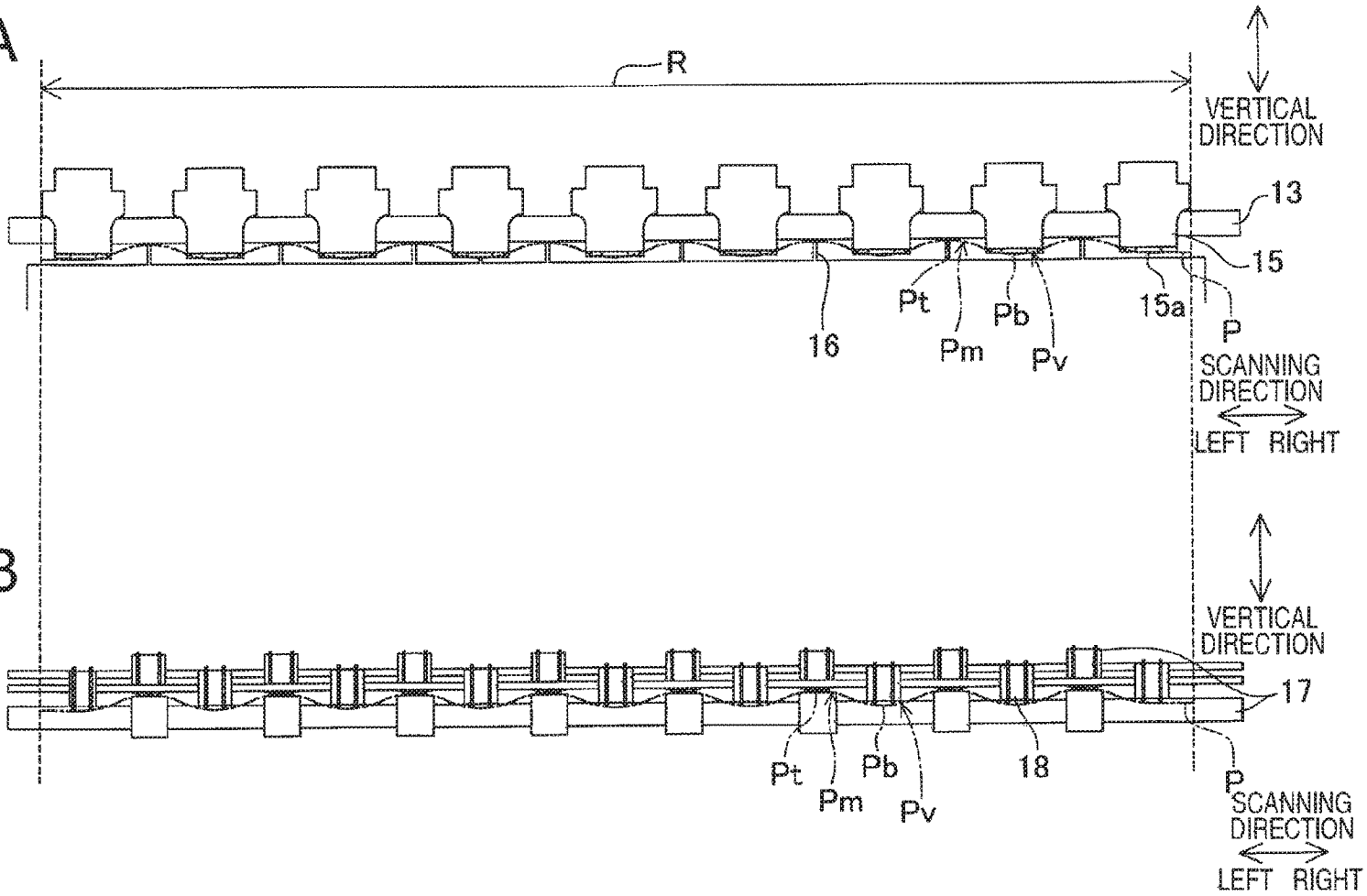

FIG. 3A schematically shows a part of the printing unit when viewed along an arrow IIIA shown in FIG. 2 in the embodiment according to one or more aspects of the present invention.

FIG. 3B schematically shows a part of the printing unit when viewed along an arrow IIIB shown in FIG. 2 in the embodiment according to one or more aspects of the present invention.

Figure 4A:
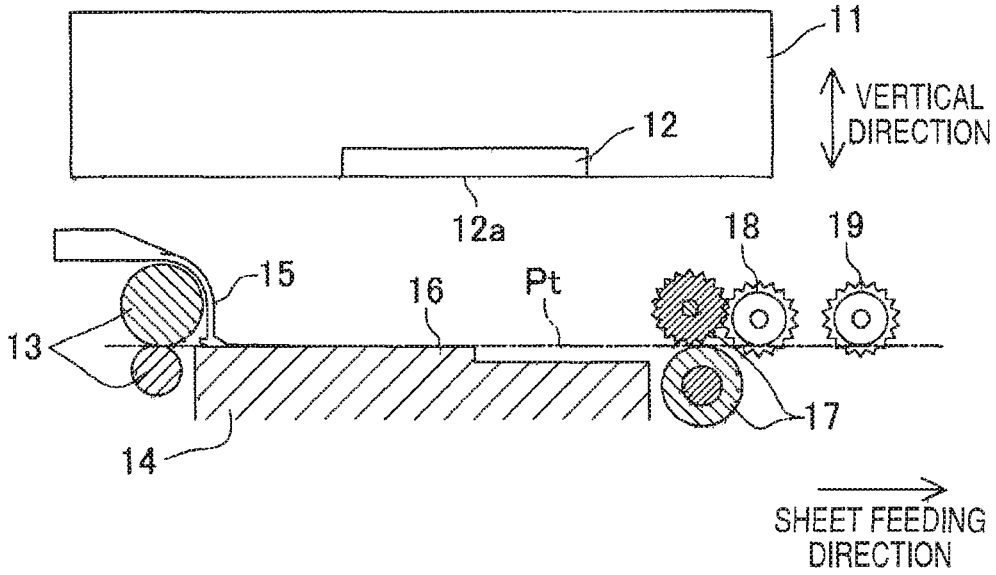

FIG. 4A is a cross-sectional view taken along a line IVA-IVA shown in FIG. 2 in the embodiment according to one or more aspects of the present invention.

Figure 4B:
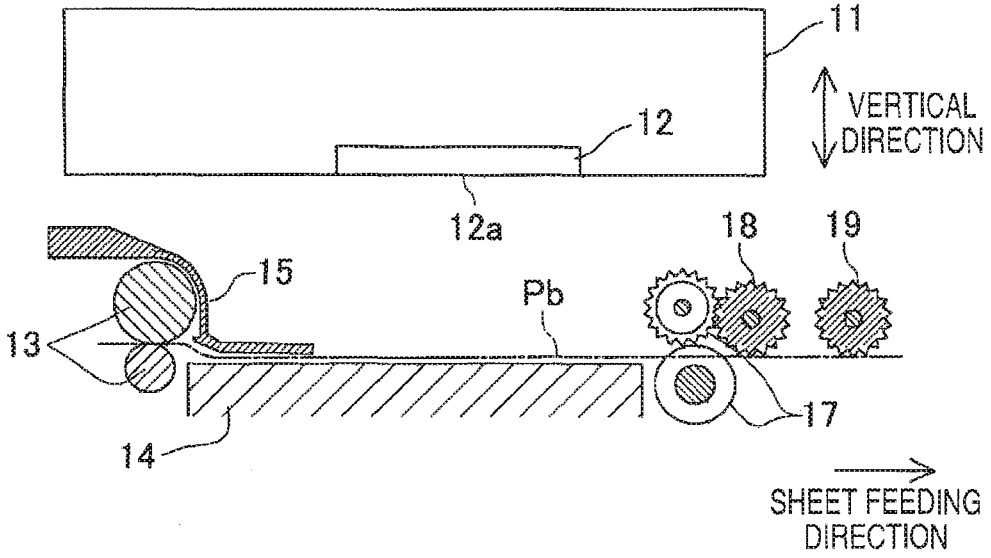

FIG. 4B is a cross-sectional view taken along a line IVB-IVB shown in FIG. 2 in the embodiment according to one or more aspects of the present invention.

Figure 5:
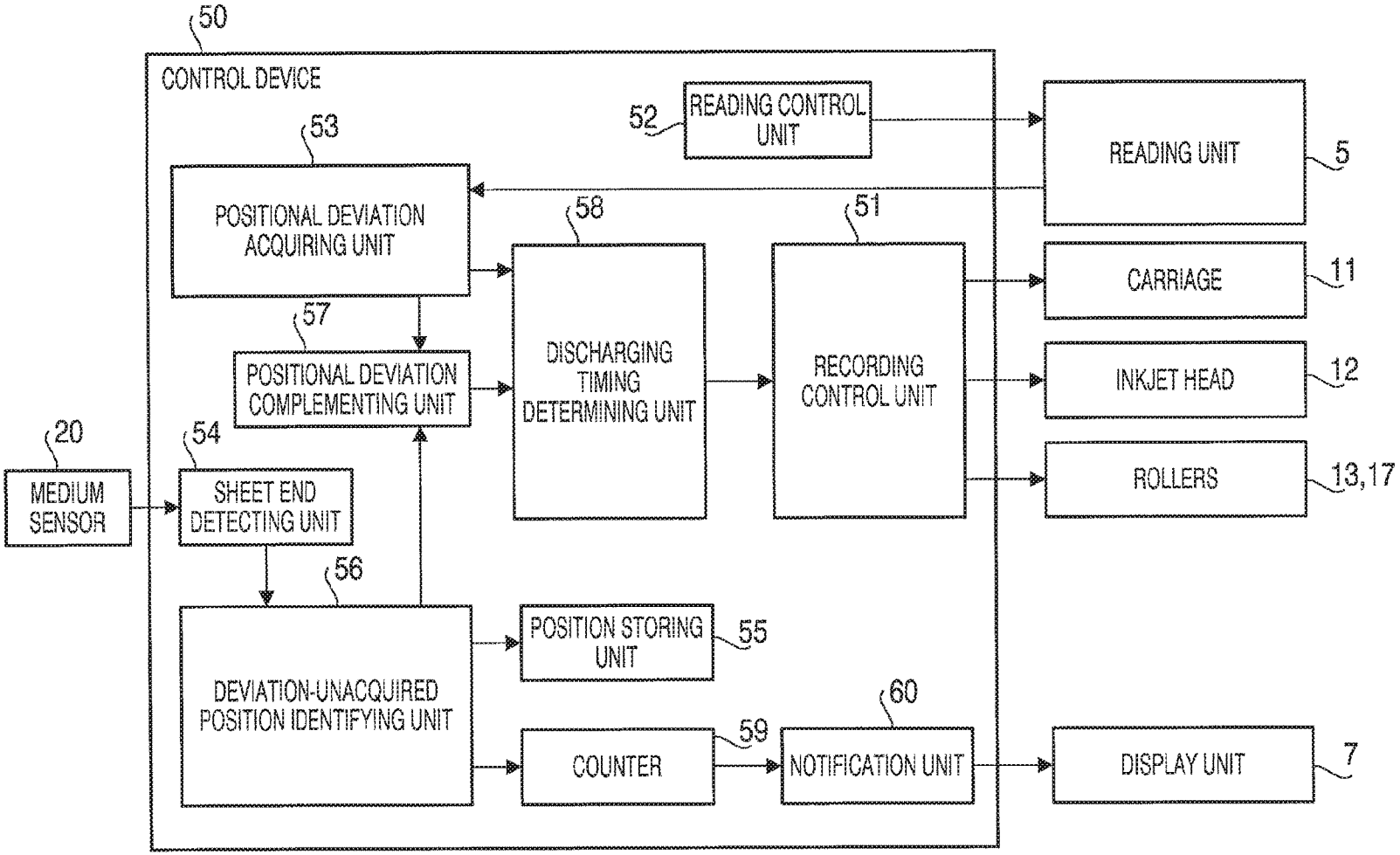

FIG. 5 is a functional block diagram of a control device of the inkjet printer in the embodiment according to one or more aspects of the present invention.

Figure 6:
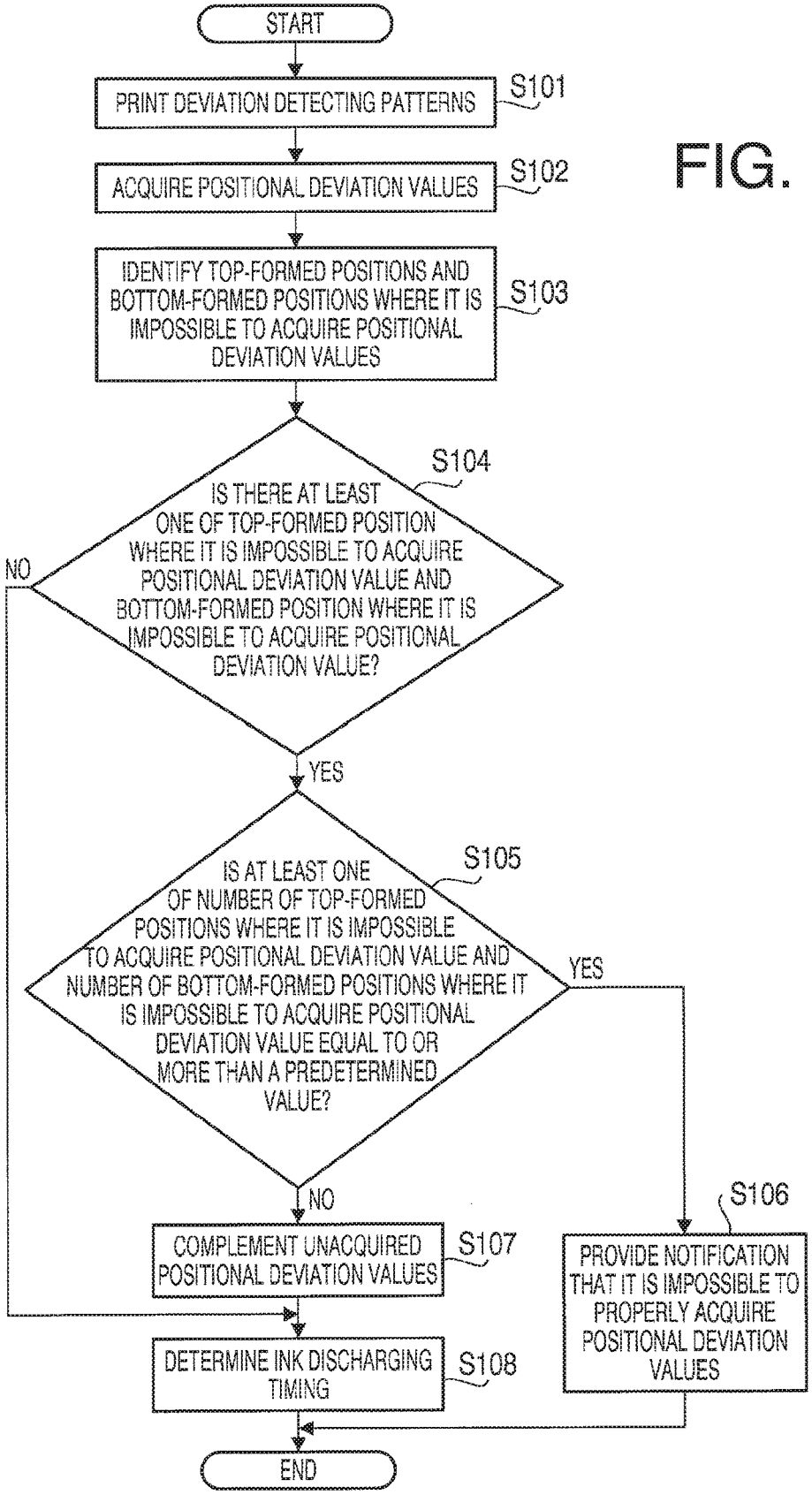

FIG. 6 is a flowchart showing a process to determine ink discharging timing to discharge ink from nozzles in the inkjet printer in the embodiment according to one or more aspects of the present invention.

Figure 7A:
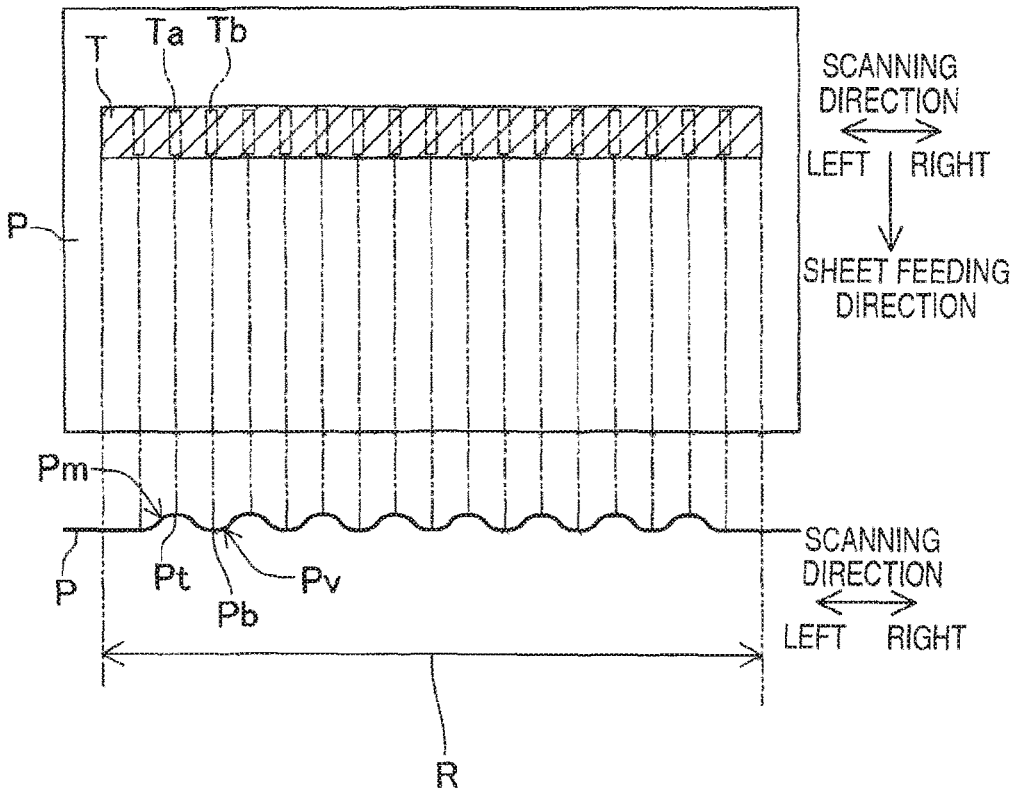

FIG. 7A shows sections to be read of a patch that includes a plurality of deviation detecting patterns printed on a recording sheet in the embodiment according to one or more aspects of the present invention.

Figure 7B:
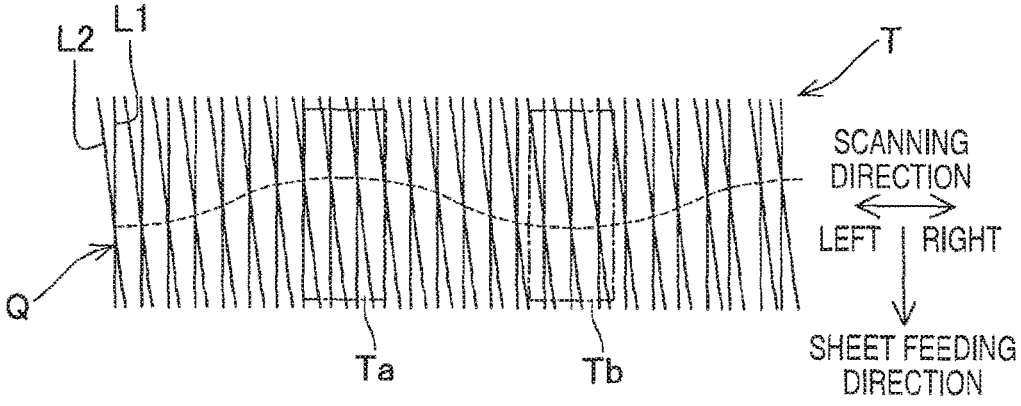

FIG. 7B is an enlarged view partially showing the patch that includes the plurality of deviation detecting patterns printed on the recording sheet in the embodiment according to one or more aspects of the present invention.

Figures 8A, 8B:
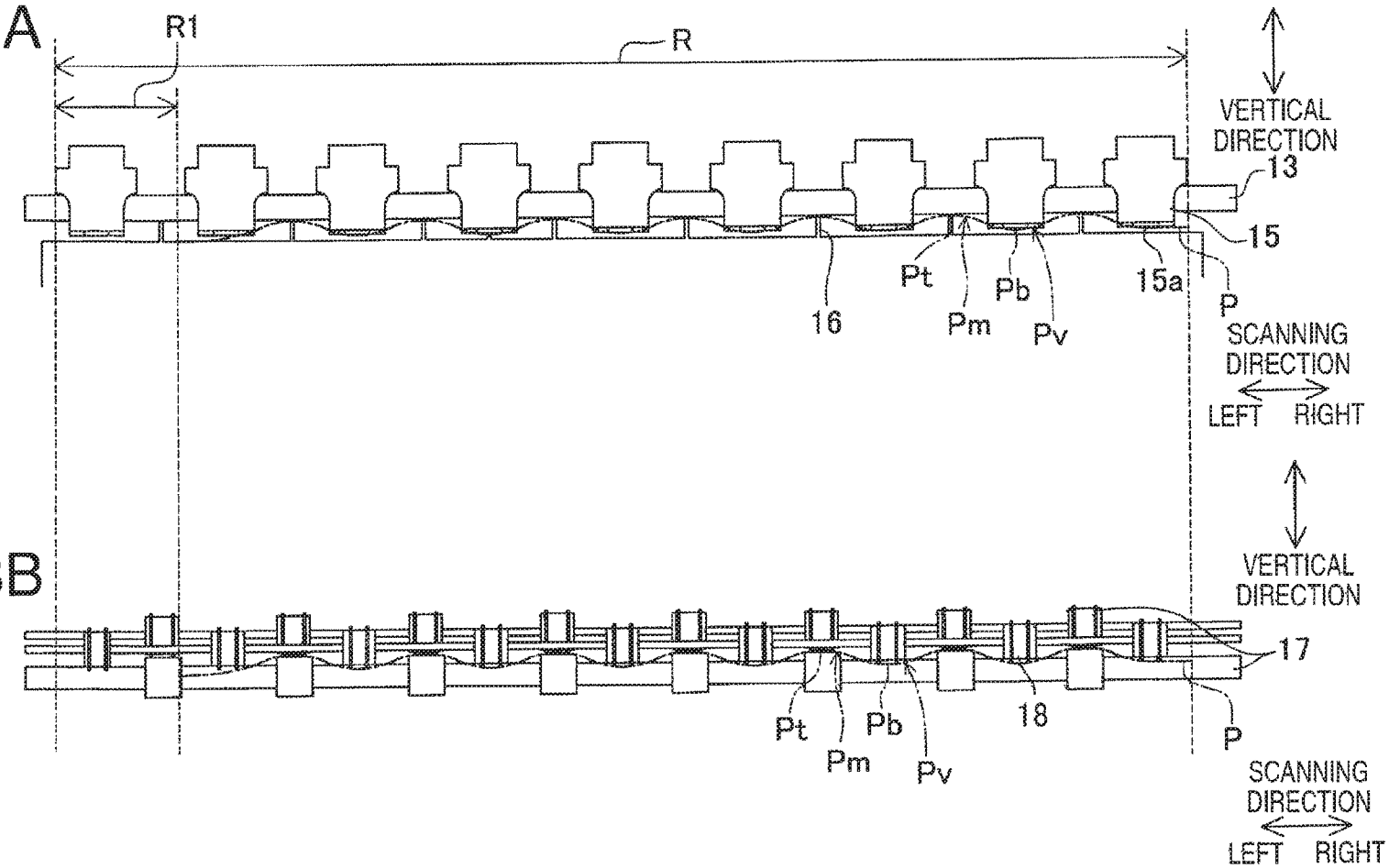

FIG. 8A schematically shows a part of the printing unit when viewed along the arrow IIIA shown in FIG. 2 when the recording sheet has a short width in a scanning direction in the embodiment according to one or more aspects of the present invention.

FIG. 8B schematically shows a part of the printing unit when viewed along the arrow IIIB shown in FIG. 2 when the recording sheet has the short width in the scanning direction in the embodiment according to one or more aspects of the present invention.

Figure 9:
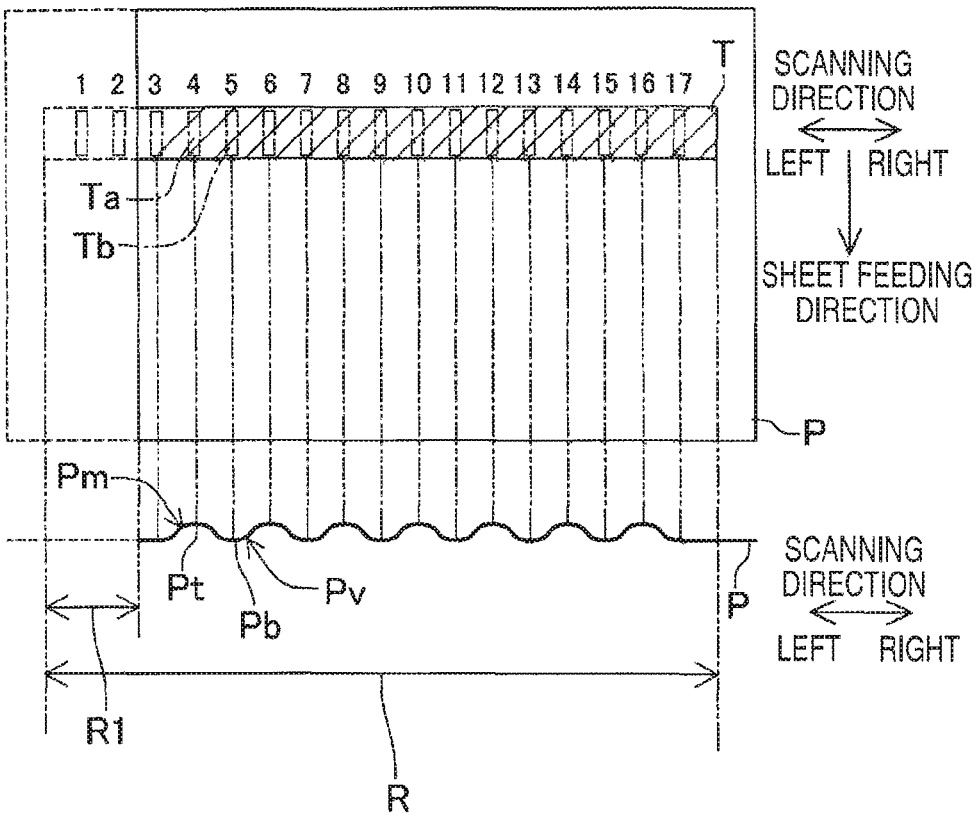

FIG. 9 shows sections to be read of a patch that includes a plurality of deviation detecting patterns printed in the state shown in FIGS. 8A and 8B in the embodiment according to one or more aspects of the present invention.

Figure 10A:
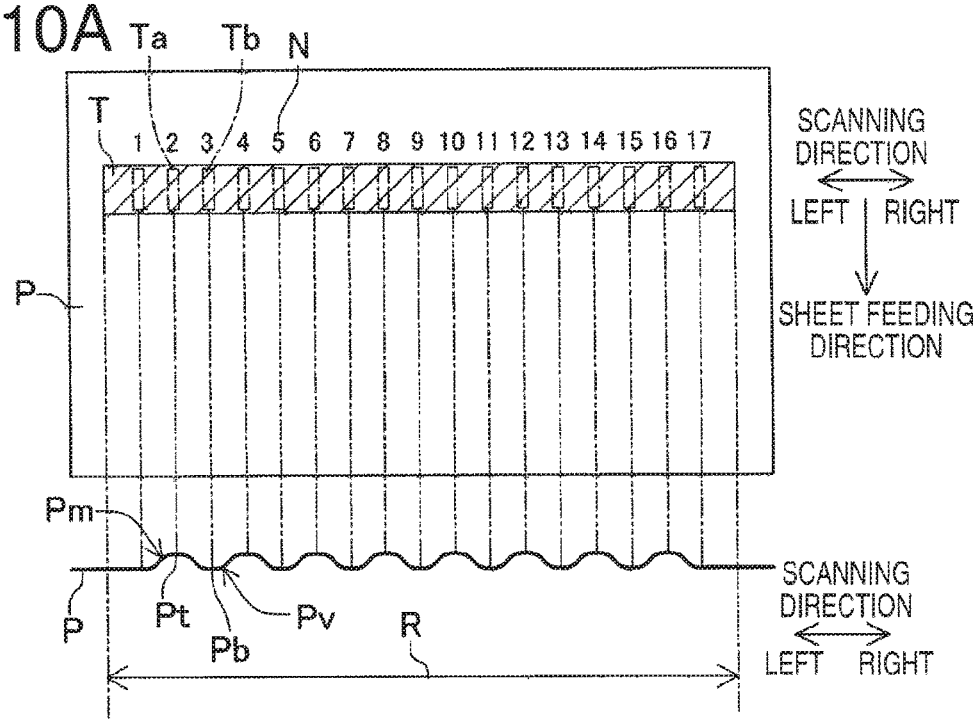

FIG. 10A shows sections to be read of a patch that includes a plurality of deviation detecting patterns printed on a recording sheet in a modification according to one or more aspects of the present invention.

Figure 10B:
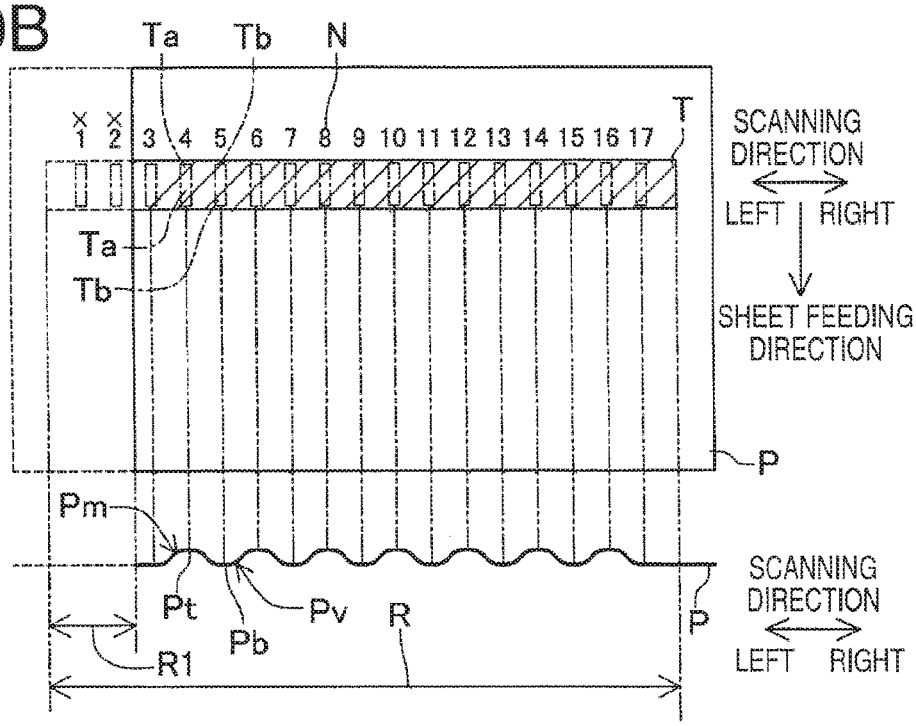

FIG. 10B shows sections to be read of a patch that includes a plurality of deviation detecting patterns printed in the state shown in FIGS. 8A and 8B in the modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation unit 6, and a display unit 7. Further, the inkjet printer 1 includes a control device 50 configured to control operations of the inkjet printer 1 (see FIG. 5).

The printing unit 2 is provided inside the inkjet printer 1. The printing unit 2 is configured to perform printing on the recording sheet P. A detailed configuration of the printing unit 2 will be described later. The sheet feeding unit 3 is configured to feed the recording sheet P to be printed by the printing unit 2. The sheet ejecting unit 4 is configured to eject the recording sheet P printed by the printing unit 2. The reading unit 5 is configured to be, for instance, an image scanner for reading images such as below-mentioned deviation detecting patterns Q for detecting deviations of ink landing positions. The operation unit 6 is provided with buttons. A user is allowed to operate the inkjet printer 1 via the buttons of the operation unit 6. The display unit 7 is configured, for instance, as a liquid crystal display, to display information when the inkjet printer 1 is used.

Subsequently, the printing unit 2 will be described. As shown in FIGS. 2 to 4, the printing unit 2 includes a carriage 11, an inkjet head 12, feed rollers 13, a platen 14, a plurality of corrugated plates 15, a plurality of ribs 16, ejection rollers 17, a plurality of corrugated spur wheels 18 and 19, and a medium sensor 20. It is noted that, for the sake of easy visual understanding in FIG. 2, the carriage 11 is indicated by a long dashed double-short dashed line, and portions disposed below the carriage 11 are indicated by solid lines.

The carriage 11 is configured to reciprocate along a guiderail (not shown) in a scanning direction. The inkjet head 12 is mounted on the carriage 11. The inkjet head 12 is configured to discharge ink from a plurality of nozzles 10 formed in an ink discharging surface 12*a* that is a lower surface of the inkjet head 12. It is noted that, the inkjet head 12 may be a line head extending over a whole length of a printable area in the scanning direction. In this case, a head scanning mechanism such as the carriage 11 may not be provided.

The feed rollers 13 are two rollers configured to pinch therebetween the recording sheet P fed by the sheet feeding unit 3 and feed the recording sheet P in a sheet feeding direction perpendicular to the scanning direction. The platen 14 is disposed to face the ink discharging surface 12*a*. The recording sheet P is fed by the feed rollers 13, along an upper surface of the platen 14.

The plurality of corrugated plates 15 are disposed to face an upper surface of an upstream end of the platen 14 in the sheet feeding direction. The plurality of corrugated plates 15 are arranged at substantially regular intervals along the scanning direction. The recording sheet P, fed by the feed rollers 13, passes between the platen 14 and the corrugated plates 15. At this time, pressing surfaces 15*a*, which are lower surfaces of the plurality of corrugated plates 15, press the recording sheet P from above.

Each individual rib 16 is disposed between corresponding two mutually-adjacent corrugated plates 15 in the scanning direction, on the upper surface of the platen 14. The plurality of ribs 16 are arranged at substantially regular intervals along the scanning direction. Each rib 16 protrudes from the upper surface of the platen 14 up to a level higher than the pressing surfaces 15*a* of the corrugated plates 15. Each rib 16 extends from an upstream end of the platen 14 toward a downstream side in the sheet feeding direction. Thereby, the recording sheet P on the platen 14 is supported from underneath by the plurality of ribs 16.

The ejection rollers 17 are two rollers configured to pinch therebetween portions of the recording sheet P that are located in the same positions as the plurality of ribs 16 in the scanning direction and feed the recording sheet P toward the sheet ejecting unit 4. An upper one of the ejection rollers 17 is provided with spur wheels so as to prevent the ink attached onto the recording sheet P from transferring to the upper ejection roller 17.

The plurality of corrugated spur wheels 18 are disposed substantially in the same positions as the corrugated plates 15 in the scanning direction, at a downstream side relative to the ejection rollers 17 in the sheet feeding direction. The plurality of corrugated spur wheels 19 are disposed substantially in the same positions as the corrugated plates 15 in the scanning direction, at a downstream side relative to the corrugated spur wheels 18 in the sheet feeding direction. In addition, the plurality of corrugated spur wheels 18 and 19 are placed at a level lower than a position where the ejection rollers 17 pinch the recording sheet P therebetween, in the vertical direction. The plurality of corrugated spur wheels 18 and 19 are configured to press the recording sheet P from above at the level. Further, each of the plurality of corrugated spur wheels 18 and 19 is not a roller having a flat outer circumferential surface but a spur wheel. Therefore, it is possible to prevent the ink attached onto the recording sheet P from transferring to the plurality of corrugated spur wheels 18 and 19.

Thus, the recording sheet P on the platen 14 is pressed from above by the plurality of corrugated plates 15 and the plurality of corrugated spur wheels 18 and 19, and is supported from underneath by the plurality of ribs 16. Thereby, as shown in FIG. 3, the recording sheet P on the platen 14 is bent and deformed in such a wave shape that mountain portions Pm protruding upward (i.e., toward the ink discharging surface 12*a*) and valley portions Pv recessed downward (i.e., in a direction opposite to the direction toward the ink discharging surface 12*a*) are alternately arranged. Further, each mountain portion Pm has a top portion (peak portion) Pt, protruding up to the highest position of the mountain portion Pm, which is located substantially in the same position as the center of the corresponding rib 16 in the scanning direction. Each valley portion Pv has a bottom portion Pb, recessed down to the lowest position of the valley portion Pv, which is located substantially in the same position as the corresponding corrugated plate 15 and the corresponding corrugated spur wheels 18 and 19.

The medium sensor 20 is mounted on the carriage 11 and is configured to detect whether there is a recording sheet P on the platen 14. Specifically, for instance, the medium sensor 20 includes a light emitting element and a light receiving element. The medium sensor 20 emits light from the light emitting element toward the upper surface of the platen 14. The upper surface of the platen 14 is black.

Therefore, when there is not a recording sheet P on the platen 14, the light emitted from the light emitting element is not reflected by the upper surface of the platen 14 or received by the light receiving element. Meanwhile, when there is a recording sheet P on the platen 14, the light emitted from the light emitting element is reflected by the recording sheet P and received by the light receiving element. Thus, the medium sensor 20 detects whether there is a recording sheet P on the platen 14, based on whether the light receiving element receives the light emitted from the light emitting element.

The printing unit 2 configured as above performs printing on the recording sheet P by discharging ink from the inkjet head 12 reciprocating together with the carriage 11 along the scanning direction, while feeding the recording sheet P in the sheet feeding direction by the feed rollers 13 and the ejection rollers 17.

Next, an explanation will be provided about the control device 50 for controlling the operations of the inkjet printer 1. The control device 50 includes a central processing unit (CPU), a read only memory (ROM), a random access memory (RAM), and control circuits. The control device 50 is configured to function as various elements such as a recording control unit 51, a reading control unit 52, a positional deviation acquiring unit 53, a sheet end detecting unit 54, a position storing unit 55, a deviation-unacquired position identifying unit 56, a positional deviation complementing unit 57, a discharging timing determining unit 58, a counter 59, and a notification unit 60 (see FIG. 5).

The recording control unit 51 is configured to control operations of the carriage 11, the inkjet head 12, the feed rollers 13, and the ejection rollers 17 in printing by the inkjet printer 1. The reading control unit 52 is configured to control operations of the reading unit 5 to read images such as the below-mentioned deviation detecting patterns Q (see FIGS. 7A and 7B). The positional deviation acquiring unit 53 acquires positional deviation values of ink droplets landing on top-formed positions (where the top portions Pt are formed) and bottom-formed positions (where the bottom portions Pb are formed), from the below-mentioned deviation detecting patterns Q read by the reading unit 5. It is noted that the positional deviation values may be referred to as "gap information" related to a gap between the ink discharging surface 12*a* and each individual portion of the top portions Pt and the bottom portions Pb.

The sheet end detecting unit 54 is configured to detect both ends of the recording sheet P in the scanning direction based on detection results of the medium sensor 20. Specifically, the sheet end detecting unit 54 detects a position of a boundary between an area where the medium sensor 20 detects the recording sheet P and an area where the medium sensor 20 does not detect the recording sheet P as a position of one of the both ends of the recording sheet P in the scanning direction. The position storing unit 55 stores a plurality of top-formed positions and a plurality of bottom-formed positions.

The deviation-unacquired position identifying unit 56 identifies a top-formed position where it is impossible to acquire a positional deviation value (e.g., where the positional deviation acquiring unit 53 has failed to acquire a positional deviation value), of the plurality of top-formed positions, based on the plurality of top-formed positions stored in the position storing unit 55 and the positions of the ends of the recording sheet P detected by the sheet end detecting unit 54, in a below-mentioned manner. Likewise, the deviation-unacquired position identifying unit 56 identifies a bottom-formed position where it is impossible to acquire a positional deviation value (e.g., where the positional deviation acquiring unit 53 has failed to acquire a positional deviation value), of the plurality of bottom-formed positions, based on the plurality of bottom-formed positions stored in the position storing unit 55 and the positions of the ends of the recording sheet P detected by the sheet end detecting unit 54, in the below-mentioned manner. The positional deviation complementing unit 57 is configured to complement (fill up) an unacquired positional deviation value corresponding to each position of the top-formed position(s) and the bottom-formed position(s) identified by the deviation-unacquired position identifying unit 54 as positions where it is impossible to acquire a positional deviation value.

The discharging timing determining unit 58 determines ink discharging timing (moments) to discharge ink from the nozzles 10, based on the positional deviation values with respect to the ink landing positions. The counter 59 counts the number of the top-formed positions identified by the deviation-unacquired position identifying unit 54 as top-formed positions where it is impossible to acquire a positional deviation value. Likewise, the counter 59 counts the number of the bottom-formed positions identified by the deviation-unacquired position identifying unit 54 as bottom-formed positions where it is impossible to acquire a positional deviation value. The notification unit 60 provides a notification that it is impossible to properly acquire the positional deviation values, for instance, by displaying the notification on the display unit 7, when at least one of the number of the top-formed positions and the number of the bottom-formed positions counted by the counter 59 is equal to or more than a predetermined value.

Subsequently, an explanation will be provided about a process to determine the ink discharging timing to discharge ink from the nozzles 10 in the inkjet printer 1, with reference to FIG. 6. In order to determine the ink discharging timing to discharge ink from the nozzles 10, firstly, the control device 50 (the recording control unit 51) controls the printing unit 2 to print, on the recording sheet P, a patch T including a plurality of deviation detecting patterns Q as shown in FIGS. 7A and 7B (S101).

More specifically, for instance, the control device 50 controls the printing unit 2 to print a plurality of straight lines L1, which extend in parallel with the sheet feeding direction and are arranged along the scanning direction, by discharging ink from the nozzles 10 while moving the carriage 11 rightward along the scanning direction. After that, the control device 50 controls the printing unit 2 to print a plurality of straight lines L2, which are tilted with respect to the sheet feeding direction and intersect the plurality of straight lines L1, respectively, by discharging ink from the nozzles 10 while moving the carriage 11 leftward along the scanning direction. Thereby, as shown in FIG. 7B, the patch T is printed that includes the plurality of deviation detecting patterns Q arranged along the scanning direction, each deviation detecting pattern Q including a combination of the mutually intersecting straight lines L1 and L2. At this time, ink droplets are discharged from the nozzles 10 in accordance with design-based ink discharging timing that is determined, for example, based on an assumption that the recording sheet P is not in the wave shape but flat. Alternatively, when the positional deviation values with respect to the ink landing positions are previously adjusted, and the ink discharging timing is previously determined in accordance with below-mentioned procedures, ink droplets may be discharged from the nozzles 10 in accordance with the previously determined ink discharging timing.

Next, the control device 50 (the reading control unit 52) controls the reading unit 5 to read the printed deviation detecting patterns Q, and the control device 50 (the positional deviation acquiring unit 53) acquires the positional deviation values of ink droplets landing on the top portions Pt and the bottom portions Pb (S102). More specifically, for example, when the deviation detecting patterns Q as shown in FIGS. 7A and 7B are printed in a situation where there is a deviation between the ink landing position in the rightward movement of the carriage 11 and the ink landing position in the leftward movement of the carriage 11, the straight line L1 and the straight line L2 of each deviation detecting pattern Q are printed to be deviated from each other in the scanning direction. Therefore, the straight line L1 and the straight line L2 intersect each other in a position deviated from the center of the straight lines L1 and L2 in the sheet feeding direction depending on the positional deviation value with respect to the ink landing positions in the scanning direction. Further, when the reading unit 5 reads each deviation detecting pattern Q, the reading unit 5 detects a higher brightness at the intersection of the straight lines L1 and L2 than the brightness at any other portion of the read deviation detecting pattern Q. Accordingly, by reading each deviation detecting pattern Q and acquiring a position with the highest brightness within the read deviation detecting pattern Q, it is possible to detect the position of the intersection of the straight lines L1 and L2.

In the embodiment, the control device 50 (the reading control unit 52) controls the reading unit 5 to read deviation detecting patterns Q, of the plurality of deviation detecting patterns Q, in a section Ta and a section Tb that respectively correspond to each top portion Pt and each bottom portion Pb within the patch T. Further, the control device 50 (the positional deviation acquiring unit 53) acquires the position with the highest brightness within each individual read deviation detecting pattern Q, so as to acquire the positional deviation values of ink droplets landing on the plurality of top portions Pt and the plurality of bottom portions Pb.

As described above, in S102, the control device 50 controls the reading unit 5 to read only the deviation detecting patterns Q in the sections Ta and the sections Tb. Therefore, in S101, the control device 50 may control the printing unit 2 to print at least the deviation detecting patterns Q in the sections Ta and the sections Tb.

Subsequently, the control device 50 (the deviation-unacquired position identifying unit 56) identifies a top-formed position where it is impossible to acquire a positional deviation value in S102 and a bottom-formed position where it is impossible to acquire a positional deviation value in S102 (S103).

More specifically, when the recording sheet P, on which the patch T is to be printed, is placed over a whole range R in the scanning direction within which the plurality of corrugated plates 15, the plurality of ribs 16, and the plurality of corrugated spur wheels 18 and 19 are disposed, the recording sheet P is deformed in such a wave shape that the top portion Pt and the bottom portion Pb are formed in every top-formed position and every bottom-formed position, respectively. Accordingly, in S101, it is possible to print the deviation detecting patterns Q corresponding to every top-formed position and every bottom-formed position. Further, in S102, by reading the printed deviation detecting patterns Q, it is possible to acquire the positional deviation values in every top-formed position and every bottom-formed position. Namely, in this case, there is not a top-formed position or a bottom-formed position where it is impossible to acquire a positional deviation value.

On the contrary, for instance, as shown in FIG. 8, when the width of the recording sheet P in the scanning direction is shorter than the length of the range R, and the recording sheet P is not placed in a partial range R1 of the range R, it is impossible to form a top portion Pt or a bottom portion Pb in the top-formed position or the bottom-formed position in the partial range R1. Further, since the recording sheet P is not in the partial range R1, in S101, it is impossible to print a deviation detecting pattern Q corresponding to the top-formed position or the bottom-formed position in the partial range R1.

A specific explanation will be provided below with reference to FIG. 9, in which reference numbers "1" to "17" are assigned to the plurality of sections Ta and Tb (unlike a below-mentioned modification as shown in FIG. 10, the numbers are not actually printed on the recording sheet P). When the recording sheet P is not in the partial range R1, for example, the recording sheet P does not have any portion corresponding to the section Ta of the reference number "1" or the section Tb of the reference number "2." Therefore, it is impossible to print a deviation detecting pattern Q in the section Ta of the reference number "1" or the section Tb of the reference number "2."

Hence, in S102, it is impossible to acquire a positional deviation value in the top-formed position or the bottom-formed position within the partial range R1. Further, in this case, the control devise 50 may issue an error notification in an operation of reading the deviation detecting patterns Q in S102. Alternatively, the control device 50 may complement unacquired positional deviation values corresponding to the unprinted deviation detecting patterns Q in S102, with setting values previously set in the inkjet printer 1. However, when the control device 50 issues an error notification, it may result in an increased number of operations, which may include an additional operation of printing the patch T. Meanwhile, when the control device 50 complements unacquired positional deviation values corresponding to the unprinted deviation detecting patterns Q with setting values previously set in the inkjet printer 1, it is impossible to configure accurate setting values.

In the embodiment, in S103, the control device 50 (the deviation-unacquired position identifying unit 56) identifies the top-formed position and the bottom-formed position that are out of the both ends, detected by the sheet end detecting unit 54, of the recording sheet P in the scanning direction, among the top-formed positions and the bottom-formed positions stored in the position storing unit 55, as a top-formed position where it is impossible to acquire a positional deviation value and a bottom-formed position where it is impossible to acquire a positional deviation value.

When determining that there is not a top-formed position where it is impossible to acquire a positional deviation value or a bottom-formed position where it is impossible to acquire a positional deviation value (S104: No), the control device 50 goes to S108. Meanwhile, when determining that there is at least one of a top-formed position where it is impossible to acquire a positional deviation value and a bottom-formed position where it is impossible to acquire a positional deviation value (S104: Yes), the control device 50 determines whether at least one of the number of top-formed positions where it is impossible to acquire a positional deviation value and the number of bottom-formed positions where it is impossible to acquire a positional deviation value is equal to or more than a predetermined value (S105).

When determining that at least one of the number of top-formed positions where it is impossible to acquire a positional deviation value and the number of bottom-formed positions where it is impossible to acquire a positional deviation value is equal to or more than the predetermined value (S105: Yes), the control device 50 (the notification unit 60) provides a notification that it is impossible to properly acquire positional deviation values, for instance, by displaying the notification on the display unit 7 (S106). The notification provided in S106 prompts the user to reattempt at printing the deviation detecting patterns Q on another recording sheet P or to check components (such as the corrugated plates 15 and the corrugated spur wheels 18 and 19) of the inkjet printer 1. After S106, the control device 50 terminates the process shown in FIG. 6.

Meanwhile, when determining that both the number of top-formed positions where it is impossible to acquire a positional deviation value and the number of bottom-formed positions where it is impossible to acquire a positional deviation value is less than the predetermined value (S105: No), the control device 50 (the positional deviation complementing unit 57) complements (fills up) unacquired positional deviation values corresponding to the top-formed position(s) where it is impossible to acquire a positional deviation value and the bottom-formed position(s) where it is impossible to acquire a positional deviation value (S107).

Specifically, in S107, the control device 50 (the positional deviation complementing unit 57) complements an unacquired positional deviation value corresponding to each of the top-formed positions where it is impossible to acquire a positional deviation value, with the average value of successfully acquired positional deviation values in the other top-formed positions. Likewise, the control device 50 (the positional deviation complementing unit 57) complements an unacquired positional deviation value corresponding to each of the bottom-formed positions where it is impossible to acquire a positional deviation value, with the average value of successfully acquired positional deviation values in the other bottom-formed positions. After that, the control device 50 proceeds to S108.

In S108, the control device 50 (the discharging timing determining unit 56) determines the ink discharging timing (moments) to discharge ink from the nozzles 10 in a printing operation, based on the positional deviation values. Specifically, when the control device 50 has successfully acquired the positional deviation values in every top-formed position and every bottom-formed position in S102, the control device 50 determines the ink discharging timing based on the positional deviation values acquired in S102. Meanwhile, when the control device 50 has failed to acquire positional deviation values in a part of the top-formed positions and the bottom-formed positions in S102, and has complemented the unacquired positional deviation values with representative values (e.g., the aforementioned average values) in S107, the control device 50 determines the ink discharging timing based on the positional deviation values acquired in S102 and the representative values used in S107.

In S102, the control device 50 acquires only the positional deviation values in the top-formed positions and the bottom-formed positions. Further, in S107, the control device 50 complements only the unacquired positional deviation value (s) corresponding to the top-formed position(s) and the bottom-formed position(s) identified as positions where it is impossible to acquire a positional deviation value. In the embodiment, as described above, the recording sheet P is deformed in such a wave shape that the top portions Pt and the bottom portions Pb are alternately arranged, by the plurality of corrugated plates 15, the plurality of ribs 16, and the plurality of corrugated spur wheels 18 and 19. Therefore, by acquiring the positional deviation values in the top-formed positions where the top portions Pt are formed and the bottom-formed positions where the bottom portions Pb are formed, it is possible to estimate positional deviation values in the other positions. Accordingly, the control device 50 determines the ink discharging timing to discharge ink onto the positions other than the top-formed positions and the bottom-formed positions, based on the estimated positional deviation values.

According to the embodiment described above, when the recording sheet P is deformed in such a wave shape that the plurality of mountain portions Pm and the plurality of valley portions Pv are alternately arranged along the scanning direction, the gap between the ink discharging surface 12*a* and the recording sheet P varies depending on portions on the recording sheet P. Further, when the gap between the ink discharging surface 12*a* and the recording sheet P varies depending on portions on the recording sheet P, there are differences between the positional deviation values caused in the rightward movement of the carriage 11 and the positional deviation values caused in the leftward movement of the carriage 11. Therefore, in order to land ink droplets in appropriate positions on such a wave-shaped recording sheet P, it is required to determine the ink discharge timing to discharge the ink droplets from the nozzles 10 depending on the gap at each portion on the recording sheet P.

Thus, in the embodiment, by printing the deviation detecting patterns Q on the wave-shaped recording sheet P and reading the printed deviation detecting patterns Q, the control device 50 acquires the positional deviation values in the top-formed positions and the bottom-formed positions. Then, the control device 50 determines the ink discharging timing to discharge ink from the nozzles 10 in the printing operation, based on the acquired positional deviation values. Thereby, it is possible to land the discharged ink droplets in appropriate positions on the wave-shaped recording sheet P.

Nonetheless, at this time, as described above, in a case where the recording sheet P on which the patch T is to be printed has an inadequate length in the scanning direction, it is impossible to print deviation detecting patterns Q in a part of the top-formed positions and the bottom-formed positions. Therefore, in such a case, even when reading the deviation detecting patterns Q, the control device 50 is not allowed to acquire positional deviation values corresponding to the part of the top-formed positions and the bottom-formed positions. Thus, without any measure taken against the problem, the control device 50 might fail to determine accurate ink discharging timing to discharge ink droplets from the nozzles 10 into the part of the top-formed positions and the bottom-formed positions.

In view of the above problem, in the embodiment, when the control device 50 is not allowed to print deviation detecting patterns Q in a part of the top-formed positions and the bottom-formed positions or acquire positional deviation values corresponding to the part of the top-formed positions and the bottom-formed positions, the control device 50 complements the unacquired positional deviation values corresponding to the part of the top-formed positions and the bottom-formed positions. Thereby, even in a situation where it is impossible to acquire a positional deviation value corresponding to a part of the top-formed positions and the bottom-formed positions, it is possible to determine the appropriate ink discharging timing to discharge ink droplets from the nozzles into the part of the top-formed positions and the bottom-formed positions.

It is noted that the case where the recording sheet P on which the patch T is to be printed has an inadequate length in the scanning direction is, for example, a case where although the range R is set in conformity with the longitudinal length of an A4-size recording sheet, the patch T is printed on a letter-size recording sheet having a longitudinal length shorter than that of the A4-size recording sheet.

Further, there are not significant differences among the top portions Pt on the wave-shaped recording sheet P. Accordingly, in the embodiment, the control device 50 complements an unacquired positional deviation value corresponding to each of the top-formed positions where it is impossible to acquire a positional deviation value, with the average value of successfully acquired positional deviation values in the other top-formed positions. Thereby, it is possible to accurately complement the unacquired positional deviation values corresponding to the top-formed positions where it is impossible to acquire a positional deviation value.

Likewise, there are not significant differences among the bottom portions Pb on the wave-shaped recording sheet P. Accordingly, in the embodiment, the control device 50 complements an unacquired positional deviation value corresponding to each of the bottom-formed positions where it is impossible to acquire a positional deviation value, with the average value of successfully acquired positional deviation values in the other bottom-formed positions. Thereby, it is possible to accurately complement the unacquired positional deviation values corresponding to the bottom-formed positions where it is impossible to acquire a positional deviation value.

Nonetheless, when there are a lot of top-formed positions where it is impossible to acquire a positional deviation value and bottom-formed positions where it is impossible to acquire a positional deviation value, it is impossible to accurately complement unacquired positional deviation values corresponding to the top-formed positions where it is impossible to acquire a positional deviation value and the bottom-formed positions where it is impossible to acquire a positional deviation value. In the embodiment, when determining that at least one of the number of top-formed positions where it is impossible to acquire a positional deviation value and the number of bottom-formed positions where it is impossible to acquire a positional deviation value is equal to or more than the predetermined value, the control device 50 provides a notification that it is impossible to properly acquire positional deviation values, without determining the ink discharging timing. Thereby, it is possible to prompt the user to reattempt at printing the deviation detecting patterns Q on another recording sheet P or to check components (such as the corrugated plates 15 and the corrugated spur wheels 18 and 19) of the inkjet printer 1.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

[Modifications]

In the aforementioned embodiment, in S107, the control device 50 (the positional deviation complementing unit 57) complements an unacquired positional deviation value corresponding to each of the top-formed positions where it is impossible to acquire a positional deviation value, with the average value of successfully acquired positional deviation values in the other top-formed positions. Likewise, the control device 50 (the positional deviation complementing unit 57) complements an unacquired positional deviation value corresponding to each of the bottom-formed positions where it is impossible to acquire a positional deviation value, with the average value of successfully acquired positional deviation values in the other bottom-formed positions.

However, for instance, an unacquired positional deviation value corresponding to a top-formed position where it is impossible to acquire a positional deviation value may be complemented with an acquired positional deviation value in a top-formed position closest to the top-formed position where it is impossible to acquire a positional deviation value. Likewise, an unacquired positional deviation value corresponding to a bottom-formed position where it is impossible to acquire a positional deviation value may be complemented with an acquired positional deviation value in a bottom-formed position closest to the bottom-formed position where it is impossible to acquire a positional deviation value.

For example, when the top portions Pt formed in the top-formed positions vary in their heights, there might be a certain degree of height difference between top portions Pt formed in top-formed positions far away from each other. Likewise, when the bottom portions Pb formed in the bottom-formed positions vary in their heights (depths), there might be a certain degree of height difference between bottom portions Pb formed in bottom-formed positions far away from each other. In contrast, in the aforementioned case, an unacquired positional deviation value corresponding to a top-formed position where it is impossible to acquire a positional deviation value is complemented with an acquired positional deviation value in a top-formed position closest to the top-formed position where it is impossible to acquire a positional deviation value. Further, an unacquired positional deviation value corresponding to a bottom-formed position where it is impossible to acquire a positional deviation value is complemented with an acquired positional deviation value in a bottom-formed position closest to the bottom-formed position where it is impossible to acquire a positional deviation value. Therefore, it is possible to accurately complement unacquired positional deviation values. Moreover, in this case, it is possible to complement unacquired positional deviation values in an easy and simple manner.

Furthermore, an unacquired positional deviation value corresponding to a top-formed position where it is impossible to acquire a positional deviation value may be complemented with a representative value determined based on successfully acquired positional deviation values in top-formed positions. Likewise, an unacquired positional deviation value corresponding to a bottom-formed position where it is impossible to acquire a positional deviation value may be complemented with a representative value determined based on successfully acquired positional deviation values in bottom-formed positions.

In the aforementioned embodiment, the control device 50 terminates the process shown in FIG. 6 after providing a notification that it is impossible to properly acquire the positional deviation values, when at least one of the number of top-formed positions where it is impossible to acquire a positional deviation value and the number of bottom-formed positions where it is impossible to acquire a positional deviation value is equal to or more than a predetermined value.

However, for instance, along with providing the notification in S106, the control device 50 may complement unacquired positional deviations in the same manner as S107 and may determine the ink discharging timing in the same manner as S108. In this case, the accuracy in complementing the unacquired positional deviations might be worse than the accuracy in complementing the unacquired positional deviations in S107 after the negative determination in S105 (S105: No). Nonetheless, for example, even when the user does not have at hand a recording sheet P of an appropriate size and is not allowed to reattempt at printing the deviation detecting patterns Q, it is possible to more properly determine the ink discharging timing to discharge ink from the nozzles 10 in comparison with when the control device 50 does not complement unacquired positional deviations or determine the ink discharging timing along with providing the notification.

Alternatively, without providing the notification in S106, the control device 50 may complement unacquired positional deviations in the same manner as S107 and may determine the ink discharging timing in the same manner as S108, regardless of the number of top-formed positions where it is impossible to acquire a positional deviation value or the number of bottom-formed positions where it is impossible to acquire a positional deviation value. Further, on the contrary, the control device 50 may terminate the process after providing the notification in S106 when there is even one top-formed position or bottom-formed position where it is impossible to acquire a positional deviation value.

In the aforementioned embodiment, the control device 50 (the sheet end detecting unit 54) detects the both ends in the scanning direction of the recording sheet P on which the deviation detecting patterns Q are to be printed. Further, based on the detected both ends of the recording sheet P in the scanning direction, and the top-formed positions and the bottom-formed positions stored in the position storing unit 55, the control device 50 (the deviation-unacquired position identifying unit 56) identifies one or more top-formed positions where it is impossible to acquire a positional deviation value and one or more bottom-formed positions where it is impossible to acquire a positional deviation value.

However, for instance, as shown in FIG. 10A, in the aforementioned step of S101, the control device 50 may print the same patch T as exemplified in the aforementioned embodiment, and may also print numbers N ascending from the left side in respective areas upstream relative to the sections Ta and Tb of the patch T in the sheet feeding direction. In this case, when the recording sheet P is placed over the whole range R in the scanning direction, all the deviation detecting patterns Q and all the numbers N are printed. Meanwhile, when the recording sheet P has a short width in the scanning direction, there are not printed, deviation detecting patterns Q that form a part of the sections Ta and Tb or numbers N corresponding to the part of the sections Ta and Tb. For example, as shown in FIG. 10B, deviation detecting patterns Q that form a single section Ta and a single section Tb are not printed. Further, the numbers "1" and "2," which are the respective numbers N corresponding to the single section Ta and the single section Tb, are not printed.

Accordingly, when controlling the reading unit 5 to read the deviation detecting patterns Q, the control device 50 may control the reading unit 5 to read the numbers N as well. At this time, by acquiring the smallest one of the read numbers N (in the case of FIG. 10B, the smallest number is "3"), the control device 50 may detect in which top-formed the position the deviation detecting patterns Q are not printed and detect in which bottom-formed position the deviation detecting patterns Q are not printed. Alternatively, instead of controlling the reading unit 5 to read the numbers N, the control device 50 may prompt the user to enter the smallest one of the printed numbers N.

In the aforementioned embodiment, by controlling the reading unit 5 to read the printed deviation detecting patterns Q, the control device 50 acquires the positional deviation values in the top-formed positions and the bottom-formed positions. Further, the control device 50 (more specifically, the positional deviation complementing unit 57) complements unacquired positional deviation values as needed.

However, for instance, the control device 50 may control the medium sensor 20 to read the printed deviation detecting patterns Q. In this case, when the light emitted by the light emitting element of the medium sensor 20 is incident onto the straight lines L1 and L2 of a deviation detecting pattern Q, the light is not reflected or received by the light receiving element. Meanwhile, when the light emitted by the light emitting element of the medium sensor 20 is incident onto an area on the recording sheet P where there is not printed a straight line L1 or L2, the light is reflected and received by the light receiving element. Thus, it is possible to detect existence/non-existence of the straight lines L1 and L2 based on whether the light receiving element receives the light emitted by the light emitting element. Thereby, it is possible to acquire the positional deviation value from the position of the intersection of the straight lines L1 and L2.

Alternatively, a device different from the inkjet printer 1 may be provided to read the deviation detecting patterns Q printed by the inkjet printer 1, acquire the positional deviation values, and complement unacquired positional deviation values as needed.

In this case, for instance, the positional deviation values acquired or supplied to complement the unacquired deviation values by the device different from the inkjet printer 1 may be written into the RAM of the inkjet printer 1. Further, in this case, the inkjet printer 1 may not necessarily be a multi-function peripheral having the reading unit 5. The inkjet printer 1 may be provided with only a printing function.

In the aforementioned embodiment, the control device 50 controls the reading unit 5 to read the patch T including the plurality of deviation detecting patterns Q so as to acquire the positional deviation values. However, for instance, the positional deviation values may be acquired by the following method. The method may include printing a plurality of patches T with respective ink discharging timings gradually differing by a predetermined time amount. The method may further include making the user select one of the plurality of patches T that includes a printed deviation detecting pattern Q with the straight lines L1 and L2 intersecting each other in a position closest to the center of the straight lines L1 and L2 in the sheet feeding direction (i.e., making the user select a patch T that includes a deviation detecting pattern Q printed with the smallest positional deviation value) in comparison with the other patches T, with respect to each portion of the top portions Pt and the bottom portions Pb.

In the aforementioned embodiment, the control device 50 controls the printing unit 2 to print the deviation detecting patterns Q each of which has the straight lines L1 and L2 intersecting each other, by discharging ink from the nozzles 10 while moving the carriage 11 rightward along the scanning direction to print the straight line L1 and discharging ink from the nozzles 10 while moving the carriage 11 leftward along the scanning direction to print the straight line L2.

However, for instance, deviation detecting patterns may be printed in the following method. The method may include printing a plurality of straight lines L2 on a recording sheet P, on which a plurality of lines similar to the straight lines L1 are previously formed, by discharging ink from the nozzles 10 while moving the carriage 11 rightward or leftward along the scanning direction, so as to form deviation detecting patterns each of which has a previously formed straight line and a printed straight line L2 intersecting each other. Even in this case, by reading the formed deviation detecting patterns, it is possible to acquire a positional deviation value, relative to a reference position, of an ink droplet landing in each position of the top-formed positions and the bottom-formed positions.

Further, the deviation detecting pattern is not limited to a pattern with two straight lines intersecting each other. The deviation detecting pattern may be another pattern configured to provide information regarding a positional deviation value.

In the aforementioned embodiment, by printing the deviation detecting patterns Q and reading the printed deviation detecting patterns Q, the positional deviation values in the top-formed positions and the bottom-formed positions are acquired as gap information related to a gap between the ink discharging surface 12*a* and each portion on the recording sheet P. However, different information related to the gap between the ink discharging surface 12*a* and each portion on the recording sheet P may be acquired. Further, the gap between the ink discharging surface 12*a* and each portion on the recording sheet P may be acquired by directly measuring the gap.

What is claimed is:

1. An inkjet printer comprising:

an inkjet head configured to discharge ink droplets from nozzles formed in an ink discharging surface thereof;

a sheet conveyor configured to convey a recording sheet in a conveyance direction;

a sheet deforming mechanism configured to deform, in a predetermined range in a specific direction perpendicular to the conveyance direction and parallel to the ink discharging surface, the recording sheet in a particular wave shape that has one or more top portions and one or more bottom portions, the one or more bottom portions being farther away from the ink discharging surface than the one or more top portions in a particular direction orthogonal to the ink discharging surface, the one or more top portions and the one or more bottom portions being aligned in the specific direction;

a notification device; and a controller configured to:

acquire gap information related to a gap between the ink discharging surface and the recording sheet in each individual position of one or more top-formed positions and one or more bottom-formed positions, each of the one or more top-formed positions being a position where a corresponding top portion is formed on the recording sheet, each of the one or more bottom-formed positions being a position where a corresponding bottom portion is formed on the recording sheet;

identify at least one of a specific top-formed position where the gap information is not acquired and a specific bottom-formed position where the gap information is not acquired, from among the one or more top-formed positions and the one or more bottom-formed positions; and control the notification device to provide a notification in response to identifying the at least one of the specific top-formed position and the specific bottom-formed position.

2. The inkjet printer according to claim 1, further comprising a display, wherein the controller is configured to control the notification device to provide the notification by displaying the notification on the display.

3. The inkjet printer according to claim 1, wherein the controller is further configured to complement unacquired gap information in the identified at least one of the specific top-formed position and the specific bottom-formed position, with a value determined based on respective pieces of gap information acquired in other positions of the one or more top-formed positions and the one or more bottom-formed positions.

4. The inkjet printer according to claim 1, wherein the sheet deforming mechanism is further configured to deform, in the predetermined range in the specific direction, the recording sheet in the particular wave shape that has a plurality of top portions comprising the one or more top portions and a plurality of bottom portions comprising the one or more bottom portions, the plurality of top portions and the plurality of bottom portions being alternately aligned in the specific direction, and wherein the controller is further configured to:

identify at least one specific top-formed position where the gap information is not acquired and at least one specific bottom-formed position where the gap information is not acquired, from among the plurality of top-formed positions and the plurality of bottom-formed positions; and control the notification device to provide the notification when at least one of a count of the identified at least one specific top-formed positions and a count of the identified at least one specific bottom-formed positions is equal to or more than a particular threshold.

5. The inkjet printer according to claim 1, wherein the controller is further configured to:

control the inkjet head to print deviation detecting patterns to detect positional deviation values, in the specific direction, of the ink droplets discharged from the nozzles onto the one or more top portions and the one or more bottom portions of the recording sheet that are respectively formed in the one or more top-formed positions and the one or more bottom-formed positions within the predetermined range in the specific direction;

read the deviation detecting patterns printed on the recording sheet;

acquire, as the gap information related to the gap between the ink discharging surface and the recording sheet, a positional deviation value of an ink droplet discharged in each individual position of the one or more top-formed positions and the one or more bottom-formed positions, based on the read deviation detecting patterns; and when a deviation detecting pattern corresponding to one of a particular top-formed position included in the one or more top-formed positions and a particular bottom-formed position included in the one or more bottom-formed positions is not read, determine that the positional deviation value is not acquired in the one of the particular top-formed position and the particular bottom-formed position.

6. The inkjet printer according to claim 1, wherein the controller is further configured to:

detect both ends of the recording sheet in the specific direction; and identify, from among the one or more top-formed positions, the specific top-formed position where the gap information is not acquired, based on both the detected ends of the recording sheet.

7. A method implementable on a controller coupled with an inkjet printer, the inkjet printer comprising:

an inkjet head configured to discharge ink droplets from nozzles formed in an ink discharging surface thereof;

a sheet conveyor configured to convey a recording sheet in a conveyance direction;

a sheet deforming mechanism configured to deform, in a predetermined range in a specific direction perpendicular to the conveyance direction and parallel to the ink discharging surface, the recording sheet in a particular wave shape that has one or more top portions and one or more bottom portions, the one or more bottom portions being farther away from the ink discharging surface than the one or more top portions in a particular direction orthogonal to the ink discharging surface, the one or more top portions and the one or more bottom portions being aligned in the specific direction; and a notification device, the method comprising:

acquiring gap information related to a gap between the ink discharging surface and the recording sheet in each individual position of one or more top-formed positions and one or more bottom-formed positions, each of the one or more top-formed positions being a position where a corresponding top portion is formed on the recording sheet, each of the one or more bottom-formed positions being a position where a corresponding bottom portion is formed on the recording sheet;

identifying at least one of a specific top-formed position where the gap information is not acquired and a specific bottom-formed position where the gap information is not acquired, from among the one or more top-formed positions and the one or more bottom-formed positions; and controlling the notification device to provide a notification in response to identifying the at least one of the specific top-formed position and the specific bottom-formed position.

* * * * *